United States Patent [19]

Federighi et al.

[11] 4,135,531

[45] Jan. 23, 1979

[54] DISHWASHER OPERATED SOLELY BY STEAM AND HOT WATER PRESSURE

[76] Inventors: George J. Federighi; George B. Federighi, both of 70 Thirteenth St., San Francisco, Calif. 94105

[21] Appl. No.: 830,920

[22] Filed: Sep. 6, 1977

[51] Int. Cl.[2] ..... B08B 3/02

[52] U.S. Cl. ..... 134/95; 134/102; 134/106

[58] Field of Search ..... 134/58 D, 95, 102, 106

[56] References Cited

U.S. PATENT DOCUMENTS

| | | | |
|---|---|---|---|
| 2,395,968 | 3/1946 | Hiort af Ornäs | 134/106 X |
| 2,608,981 | 9/1952 | Jackson | 134/102 |
| 2,618,281 | 11/1952 | Hiort af Ornäs | 134/106 X |
| 2,621,666 | 12/1952 | Hiort af Ornäs | 134/95 X |
| 2,782,792 | 2/1957 | Robson et al. | 134/58 D |
| 3,384,098 | 5/1968 | Swetnam | 134/102 X |

FOREIGN PATENT DOCUMENTS

| | | | |
|---|---|---|---|
| 984319 | 12/1963 | United Kingdom | 134/102 |

*Primary Examiner*—Robert L. Bleutge
*Attorney, Agent, or Firm*—William R. Piper

[57] ABSTRACT

A dishwasher that has a steam boiler containing hot water and steam under pressure. The dishwasher has a dishwashing and rinsing compartment with a body of hot water, adjustable as to depth, received in the bottom of the compartment. A time controlled device delivers steam from the boiler to steam jets in the compartment for a predetermined time period for washing the dishes. The steam jets have apparatus associated therewith that will cause the steam jets to periodically entrain hot water from the body of water to deliver a pulsating steam and hot water action against the dishes for washing them. The depth of the body of water can be raised so that only live steam and water will issue from the steam jets if desired, with no pulsating action. The time controlled device delivers hot rinse water from the boiler for rinsing the dishes in the compartment after the dishwashing operation.

7 Claims, 12 Drawing Figures

FIG-9-
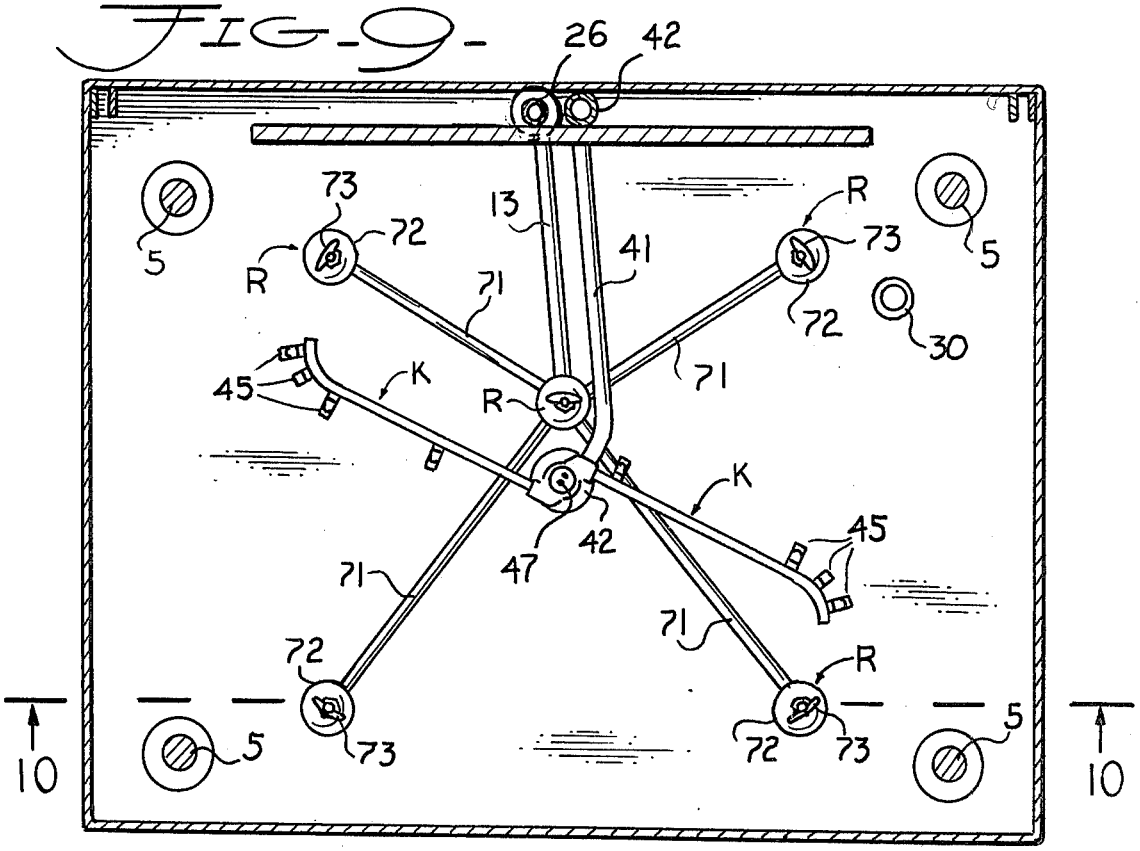
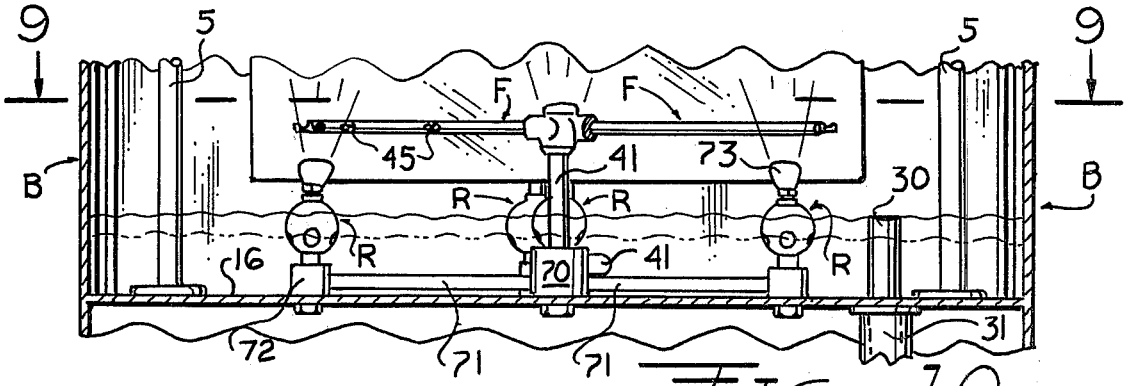
FIG 10
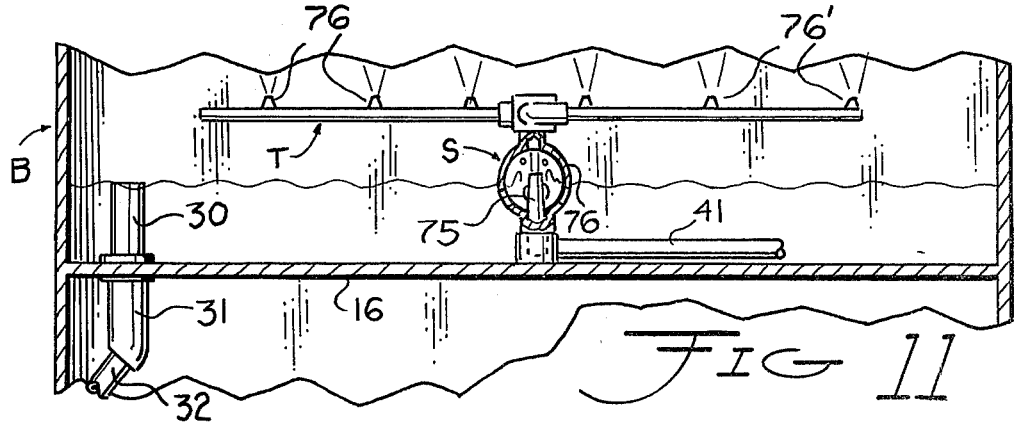
FIG 11

DISHWASHER OPERATED SOLELY BY STEAM AND HOT WATER PRESSURE

SUMMARY OF THE INVENTION

An object of our invention is to omit the need for an electric motor and pump now used to operate most dishwashing machines. Instead we use a steam boiler and convey live steam from the top of the boiler to steam jets placed in the dishwashing and rinsing compartment of the dishwasher. The steam jet may be stationary or mounted on rotatable arms for directing live steam and hot water against the dishes for washing them. In addition, the steam jet has associated with it a perforated housing that is partially submerged in the body of hot water contained in the bottom of the wash-/rinse compartment. The level of the water can be controlled so that when it is at a predetermined depth the live steam flowing through the jet will entrain hot water from the body of water and through the perforated housing for creating a pulsating water and steam effect. Then when the body of water is at a higher level there will be a steady flow of steam mixed with hot water that will be sprayed upon the dishes for washing them.

A further object of our invention is to provide a timing device to cause the dishwashing operation to take a predetermined length of time which is followed by a dish rinsing operation also of a predetermined time period. During the rinsing operation, hot water is delivered from the hot water in the boiler into rinse nozzles mounted in the wash/rinse compartment. Again the rinse nozzles may be stationary or mounted on rotatable arms that will spray the rinse water onto the dishes for rinsing and sterilizing them.

BRIEF DESCRIPTION OF THE DRAWINGS

FIG. 9 is a modified form of the dishwasher and illustrates stationary steam jets positioned in the wash-/rinse compartment and is taken along the line 9—9 of FIG. 10.

FIG. 10 is a section taken along the line 10—10 of the modified form of the dishwasher shown in FIG. 9.

FIG. 11 is a second modified form where the steam and water entraining device feeds into the lower wash arm that has spray jets mounted thereon.

DESCRIPTION OF THE PREFERRED EMBODIMENTS

Figure 1:
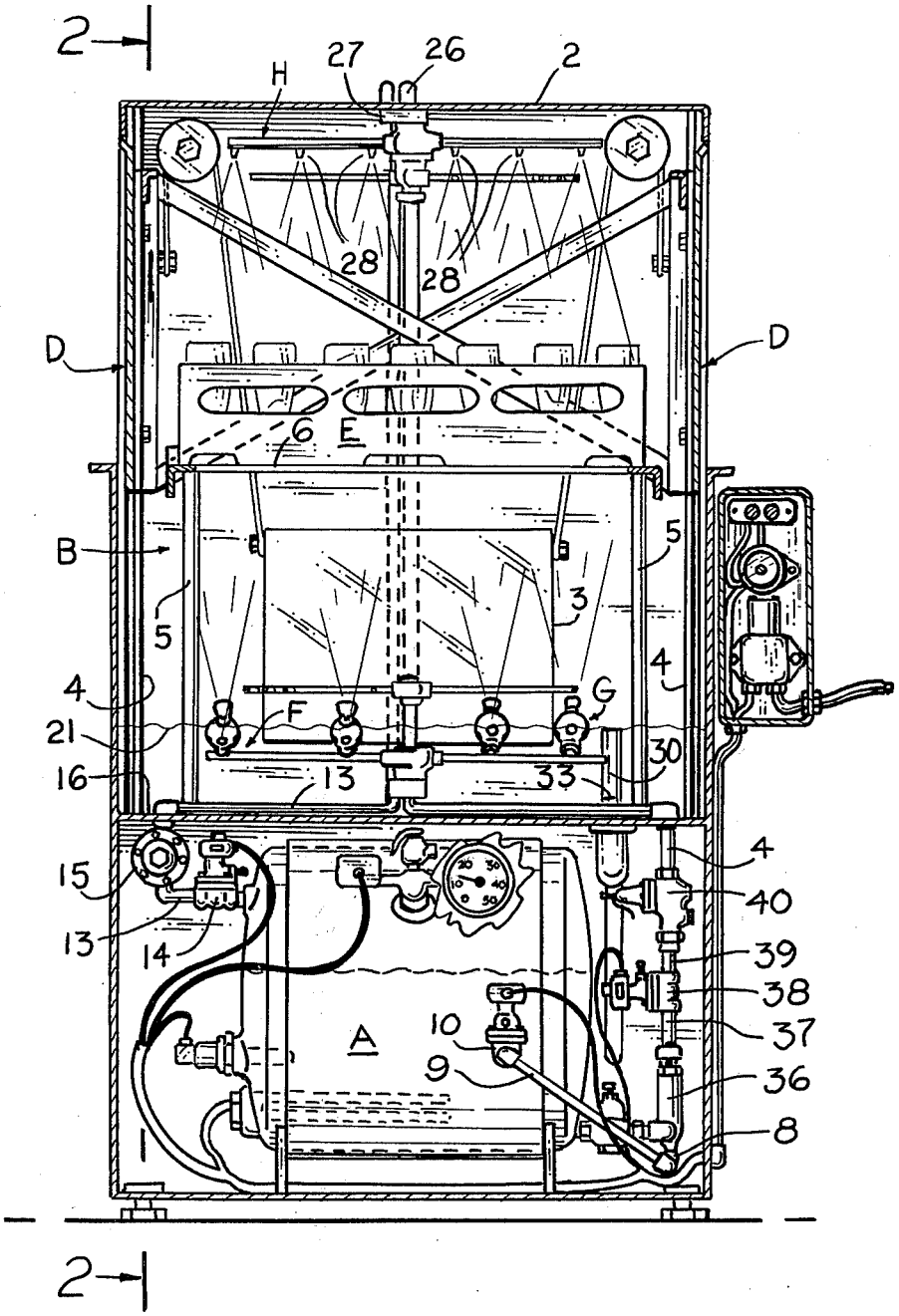
FIG. 1 is a vertical transverse section through the dishwasher and it is taken along the line 1—1 of FIG. 2.
Figure 2:
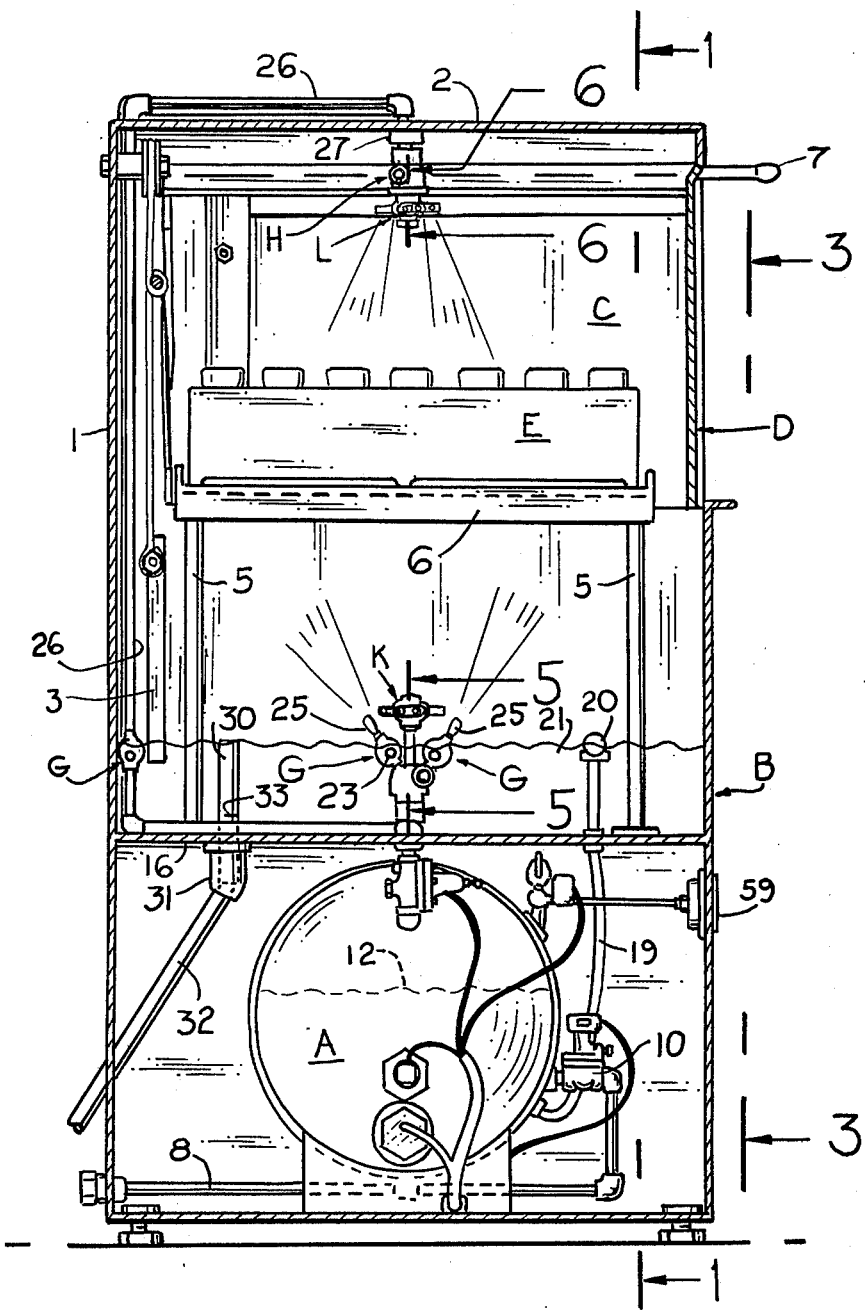
FIG. 2 is a vertical section through the dishwasher with one side wall removed and it is taken along the line 2—2 of FIG. 1.
Figure 4:
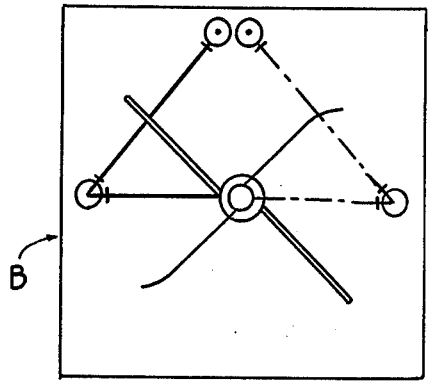
FIG. 4 is a reduced schematic showing of the steam and hot water lines for delivering steam and hot water for washing the dishes and for delivering hot rinse water to the jets in the rinse arms. This Figure is taken along the line 4—4 of FIG. 3.

In carrying out our invention we show vertical sections through the dishwasher in FIGS. 1 and 2. Both of these drawings show the dishwasher with a lower compartment for housing a steam boiler indicated generally at A, and other apparatus that will be described in detail. A tank B, is mounted above the boiler compartment and a dish washing and rinsing compartment C, is positioned above, but is in communication with the tank. The wash/rinse compartment is open on three sides and a three sided door D, is shown closing the compartment C in FIG. 2. The back wall 1 of the dishwasher and a hood 2 cooperate with the three sided door D to close the wash/rinse compartment when the door is closed. FIG. 1 shows a counterweight 3 for balancing the weight of the door and it is connected to the door by cables and pulleys. The door slides in vertical guide tracks 4, as shown in FIG. 1.

Within the tank B, we mount uprights 5 that support a platform 6 on which the dish carrying basket E, rests, see FIGS. 1 and 2. The basket will be positioned in the wash/rinse compartment C when supported by the platform 6. The platform is perforated, not shown, and the basket E has a perforated bottom, not shown, so that wash and rinse waters may be sprayed upwardly against the bottoms of the dishes in a manner hereinafter described. The platform 6 is accessible from three sides of the dishwasher when the three-sided door D, is moved downwardly into open position. We have shown the basket E, as supporting glasses although it can support any type of article needing to be washed and rinsed. The door D, has a handle 7 for raising the door into closed position or for lowering the door into open position.

We will now describe how hot water at about 140° F., is fed into the boiler A, and how steam is generated in the boiler and is fed to the wash arms and mixed with water so that steam and water will issue from the wash arms for washing the dishes during the washing cycle. If cold water is used the temperature of it would be raised to 180° F. in the boiler. Then we will set forth how hot rinse water is fed from the hot water in the boiler to the rinse arms during the dish rinsing cycle. This will be followed by the timing mechanism which controls the washing and rinsing cycles after which the entire apparatus is stopped from operating. The schematic showing of FIG. 8 illustrates all of these different features.

Figure 8:
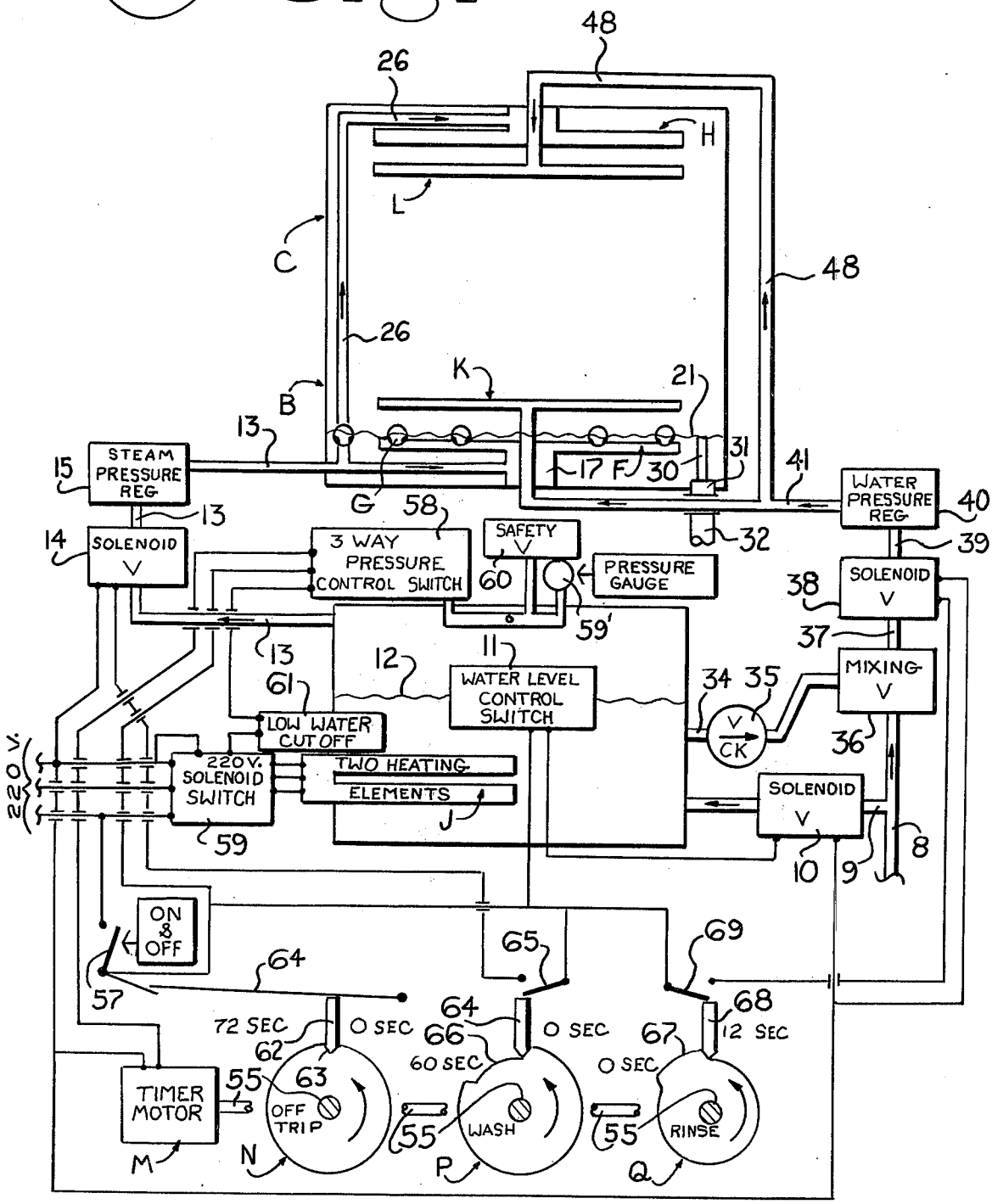
FIG. 8 is a combined electric mechanical schematic view of the entire dishwasher.

In FIG. 8, the fresh water inlet source is indicated by the pipe 8 where the hot water at about 140° F., enters and flows through a branch pipe 9, controlled by a solenoid valve, indicated diagrammatically at 10. The solenoid valve 10 is controlled by a water level control switch 11, mounted in the boiler A and holding the water level in the boiler at a predetermined line such as the line 12, shown in the boiler A in FIG. 8. When we describe the timing mechanism we will show how the water level control switch 11 opens and closes the solenoid valve 10 to automatically feed hot water to the boiler as needed.

From the top of the boiler A, in FIG. 8, a steam pipe 13 leads to a solenoid steam valve 14, and then to a steam pressure regulator 15, and finally to the wash-/rinse compartment C. Again, the operation of the solenoid steam valve 14 and the steam pressure regulator 15 will be explained when the timing mechanism is set forth in detail. FIG. 2 shows the hot water inlet pipe 8, and FIG. 1 shows the branch pipe 9 and the solenoid 10 which controls the flow of hot water into the boiler A. The same FIG. 1 shows the steam pipe 13 leading from the top of the steam boiler and controlled by the solenoid valve 14 and the steam pressure regulator 15. The portion of the steam pipe 13 that lies within the dishwasher tank B, see FIG. 1, is positioned adjacent to the bottom 16 of the tank. The pipe 13 delivers steam to a lower wash arm F, and this arm is shown in an enlarged sectional detail in FIG. 5.

Figures 5, 5A, 6, 7:
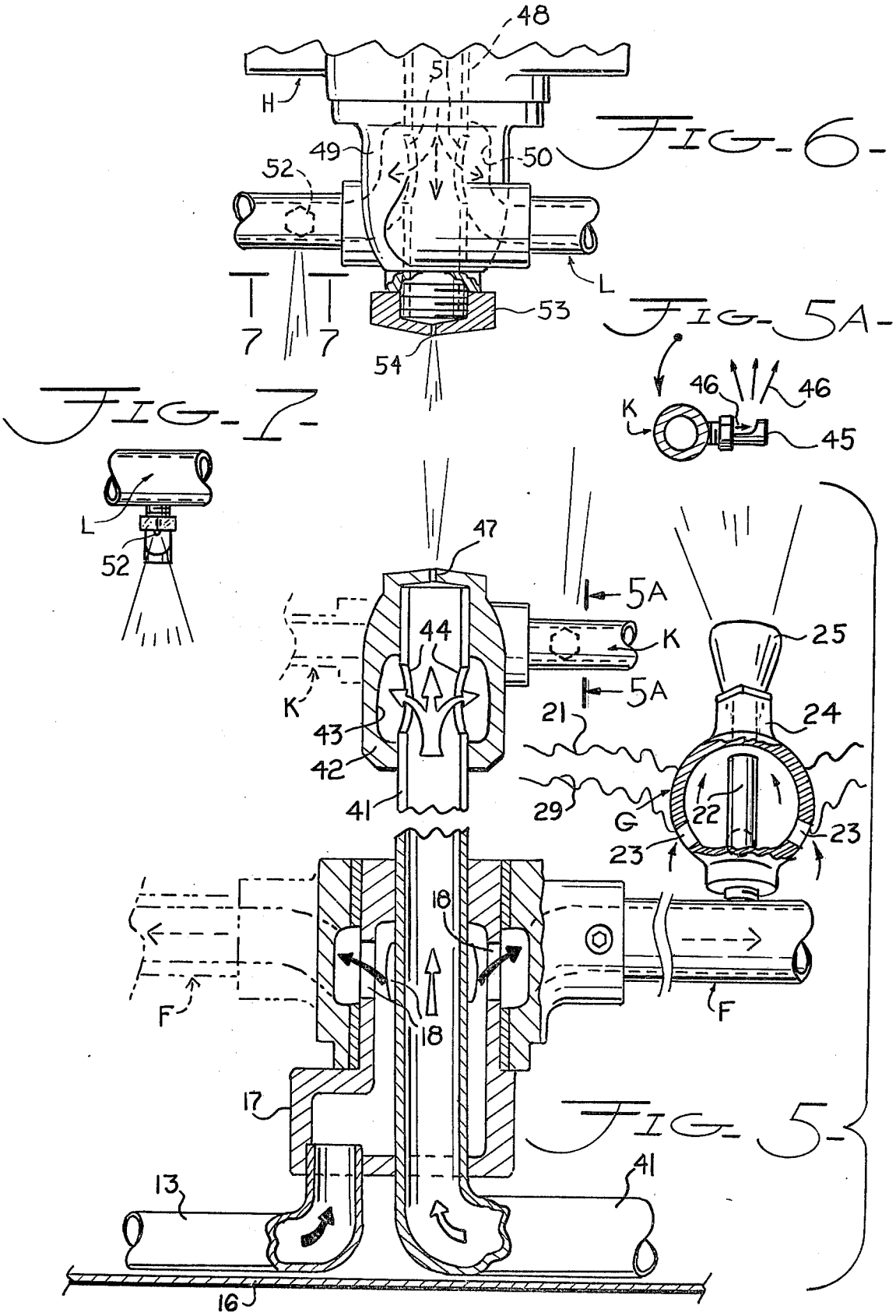
FIG. 5 is an enlarged sectional view taken along the line 5—5 of FIG. 2, and illustrates both the wash and rinse spray arms mounted at the bottom of the wash-/rinse compartment.
FIG. 5A is a section taken along the line 5A—5A of FIG. 5.
FIG. 6 is an enlarged sectional view taken along the line 6—6 of FIG. 2, and illustrates portions of the wash and rinse arms positioned in the top of the wash/rinse compartment.
FIG. 7 is a view when looking in the direction of the arrows 7—7 in FIG. 6, and shows one of the rinse spray nozzles.

The steam pipe 13 in FIG. 5, directs steam into a housing 17 and the lower wash arm F, is free to rotate about the housing and is supported by it. Openings 18 in the housing 17 permit steam to enter the hollow wash arms F even while the wash arm F, is free to rotate about the housing. A vital feature of our invention is in the type of steam jet used on the wash arm. Before describing this steam jet in detail we should point out that a body of hot wash water is received in the bottom of the tank B, see FIG. 2. A float controlled filler tube 19 communicates with the body of hot water in the boiler A and conveys this water into the tank B. The float controlled valve 20 at the outlet end of the tube 19 keeps the water in the tank at a desired level such as the level 21 shown in FIG. 2.

The water level 21 in FIG. 5 is shown by a jagged line because when the dishwasher is operating the wash arm F will be rotating in the body of water in the tank B, and will cause it to splash around. The lower wash arm F supports a number of steam jets which are spaced along the arm and communicate with the interior of the arm to receive steam therefrom. FIG. 5 shows one of these steam jets enlarged and partially in section. A ball-shaped housing G, encloses the steam jet 22 and it has openings 23 which will permit the hot wash water in the tank B, to enter the housing interior. The top of the steam jet 22 is positioned adjacent to the steam and water outlet 24 at the top of the housing G. Therefore, as steam issues from the top of the jet 22, it will entrain hot water from the housing interior so that both steam and hot water will issue from the housing outlet 24. A water and steam deflector 25, as shown in FIG. 5, is positioned at the housing outlet 24 for spraying the steam and water against the bottoms of the dishes for washing them and for directing the spray at an angle from the vertical for causing the wash arm F to rotate. FIG. 1 shows four of these steam jets and housings G mounted on the wash arm although we do not wish to be confined to any exact number.

In FIG. 8 we show a branch steam line 26 leading from the pipe 13 to an upper wash arm H, and this is shown in more detail in FIGS. 1, 2 and 6. The steam branch line enters the wash/rinse compartment C through the center of the hood 2, as shown in FIGS. 1 and 2. The steam from the pipe 26 enters a housing 27 and the upper wash arm H receives steam from this housing and is rotatably supported by it. The steam jets 28 are mounted on the upper wash arm H, and direct the steam and water in a downward direction to wash the dishes from the top and at an angle to the vertical so as to cause the upper wash arm H to rotate about the housing 27 that supports it.

We have just stated that both steam and water will issue from the steam jets 28 even though these jets are not provided with the ball-shaped perforated housings G, as are the steam jets 22 on the lower wash arm F. The reason for this is shown in FIG. 2, where we show the branch steam pipe 26 provided with a ball-shaped housing G' which is identical to the housing G shown in FIG. 5 except that the steam flowing through the jet in the housing G' receives its steam from the branch pipe 26 and instead of the steam from the jet in the ball housing G' issuing directly into the wash/rinse compartment C, it enters a continuation of the branch pipe 26 that leads to the housing 27 and the upper wash arm H. As the steam from the pipe 26 flows through the steam jet in the housing G', not shown but of the same type as the jet 22 in the housing G in FIG. 5, it will entrain water from the tank B, through the opening 23 because the housing G' is submerged in the hot water as indicated in FIG. 2. Therefore, the steam will entrain water from the housing interior and the pipe 26 will convey both steam and hot water and cause the jets 28 in the upper wash arm to dispense both steam and water for washing the dishes during the washing cycle.

Before describing the rinse cycle of the dishwasher, it is best to state at this point the provision for causing the lower and upper wash arms to deliver a pulsating wash operation of the dishes. In FIG. 5, we show that the water level 21 in the tank B, can be lowered to the level 29 for a pulsating effect to the washing operation. When the water level in the tank B, is thus lowered, the steam in flowing through the jet 22 in the housing G will entrain the water within the housing until there is no more water therein and the lower level of the water in the tank will require an appreciable amount of time before the housing interior can again be filled with water. During this short time that there is not sufficient water in the housing G to give a continuous supply of hot water to be entrained by the steam from the jet 22, only steam will flow out through the housing outlet 24. Then as soon as the housing interior fills with water, both steam and hot water will issue from the outlets 24 and the deflectors 25. A pulsating action of steam and water is the result and this is desirable at times.

The housing G' and its jet will function in the same manner as the housing G when the water level in the tank B, is lowered. This pulsating flow of steam and hot water will be conveyed through the pipe 26 from the housing G' and will issue from the jets 28 in the upper wash arm H, see FIGS. 1 and 2. In FIG. 2, we show an overflow pipe 30 in the tank B, and adjustably mounted in a connection 31 which in turn communicates with a drain pipe 32 leading to the sewer. When the overflow pipe 30 is in its uppermost position, as indicated in both FIGS. 1 and 2, the level 21 of the water in the tank B, is at a height which will assure that there will be a steady flow of steam mixed with water during the dishwashing cycle. If, however, the operator wishes to produce a pulsating action of the steam and hot water, he moves the overflow pipe 30 in the connection 31 until the mark 33 on the pipe registers with the tank bottom 16. This will drain the hot water in the tank until the water level in the tank drops to the lower water level indicated at 29 in FIG. 5. When this occurs there will be a pulsating steam and hot water sprayed upon the dishes from the lower and upper wash arms F, and H, respectively, in the manner already described during the dishwashing cycle. The float controlled valve 20 will also be moved downwardly in the tank B so that valve will maintain the lower level of water in the tank so long as the operator wishes to provide a pulsating stream and hot water spraying action on the dishes. When the operator wishes to drain the tank B of hot water, he merely has to temporarily remove the overflow pipe 30 from its connection 31 until the tank is drained.

We will now describe the apparatus for rinsing and sterilizing the dishes during the dish rinsing cycle and follow this with an explanation of the timing device that controls the entire washing and rinsing cycles. In FIG. 8, we show the boiler A with two electrical heating elements J, and these will raise the temperature of the hot water in the boiler from 140° F., to about 220° F., and the steam pressure in the boiler will be at approximately fifteen pounds to the square inch. A hot rinse water carrying pipe 34 leads from the bottom of the tank A to a check valve 35 and thence to a mixing valve 36, see also FIG. 1. The mixing valve 36 is set for a water temperature of 180° F., and if the temperature of the water in the boiler A is above this, the mixing valve 36 will permit fresh hot water from the inlet pipe 8 at 140° F., to mix with the hot water from the boiler until the hot water flowing through the pipe 37 from the mixing valve will always be at 180° F. A solenoid valve 38. controlled by the rinse cycle cam, hereinafter described, permits hot rinse water to flow into the pipe 39, only during the rinse cycle. The pipe 39 connects with a water pressure gage 40 and from here the hot rinse water flows through a pipe 41 to the lower rinse arm K, and the upper rinse arm L, rotatably mounted in the wash/rinse compartment C.

We will first describe the lower rinse arm K, and its connection with the rinse pipe 41, as shown in FIG. 5, and then will describe the upper rinse arm L, and its connections with the rinse pipe 41, as shown in FIGS. 6 and 8. In FIG. 5, we show the rinse pipe 41 extending through the interior of the housing 17 and rotatably supporting at its upper end a hub 42 for the lower rinse arm K. The hub has an annular inner hot rinse water passage 43 that communicates with the hollow interiors of the lower rinse arms K. Also, when the hub 42 is mounted on the open top of the pipe 41, the annular inner passage 43 will register with the openings 44 in the pipe and, therefore, the hub 42 and lower rinse arms K, are free to rotate about the pipe 41 and be removably supported by the pipe and the hot rinse water is free to flow continuously from the pipe 41 into the lower rinse arm at all times during the rinsing cycle. FIG. 5A, is a section through the lower rinse arm K, and it shows one of the hot water jets 45 extending from the arm and communicating with its hollow interior. Arrows 46 illustrate how the hot rinse water is sprayed upwardly from the jet 45 to rinse the dishes in the dish carrying basket E. FIG. 5 further shows the top of the hub 42 as having a plurality of openings 47 through which a portion of the hot rinse water passes to function as a center spray against the dishes in the basket E.

The upper rinse arm L, is shown in detail in FIGS. 6 and 7. A branch rinse carrying water pipe 48 connects with the rinse pipe 41, see FIG. 8, and it extends through the center of the upper wash arm H, see FIG. 6 and down into the interior of a hub 49 for the upper rinse arm L. This hub has an interior annular water passage 50 that communicates with openings 51 in the pipe 48, and the hub interior passage also communicates with the hollow interior of the upper rinse arm L. FIG. 7 shows one of the rinse water jets 52 and it is of the same type as the jet 45 for the lower rinse arm K. The water jets 52 are spaced along the upper rinse arm L, and will direct the hot rinse water downwardly upon the dishes for rinsing and sterilizing them. A cap 53 is threaded onto the threaded end of the rinse pipe 48, as shown in FIG. 6 and it will act as a supporting bearing for the rotating hub 49 and upper rinse arm L. The cap 53 has center openings 54 through which a hot rinse spray is directed against the dishes for rinsing and sterilizing them.

We will now describe the timing mechanism and the electrical circuits for operating the dishwasher through its wash and rinse cycles. A timer motor M, is shown diagrammatically in FIG. 8 and the motor shaft 55 operates three cams and is shown schematically with the three cams being shown in plan view. The first cam N times the entire dishwashing and rinsing operations and is set to make one complete revolution in 72 seconds, although we do not want to be limited to any specific time interval. The next cam P, controls the wash cycle and is set for a b 60 second cycle while the third cam Q is set for 12 seconds and controls the rinse cycle. All three cams rotate in unison and at the end of the 72 second cycle the dishwasher is stopped from further operation.

An ON/OFF switch 57 is shown in FIG. 8 and when it is manually closed a circuit is closed to a three-way pressure control switch 58. This switch 58 will immediately close a solenoid switch 59 which in turn will cause the two heating elements J to raise the hot water in the boiler A from the 140° F., to 180° F., Also, FIG. 2 shows the tube 19 delivering water from the boiler to the tank in order to fill the tank B with hot water up to the level 21. The float valve 20 will automatically keep the water at this level.

Figure 3:
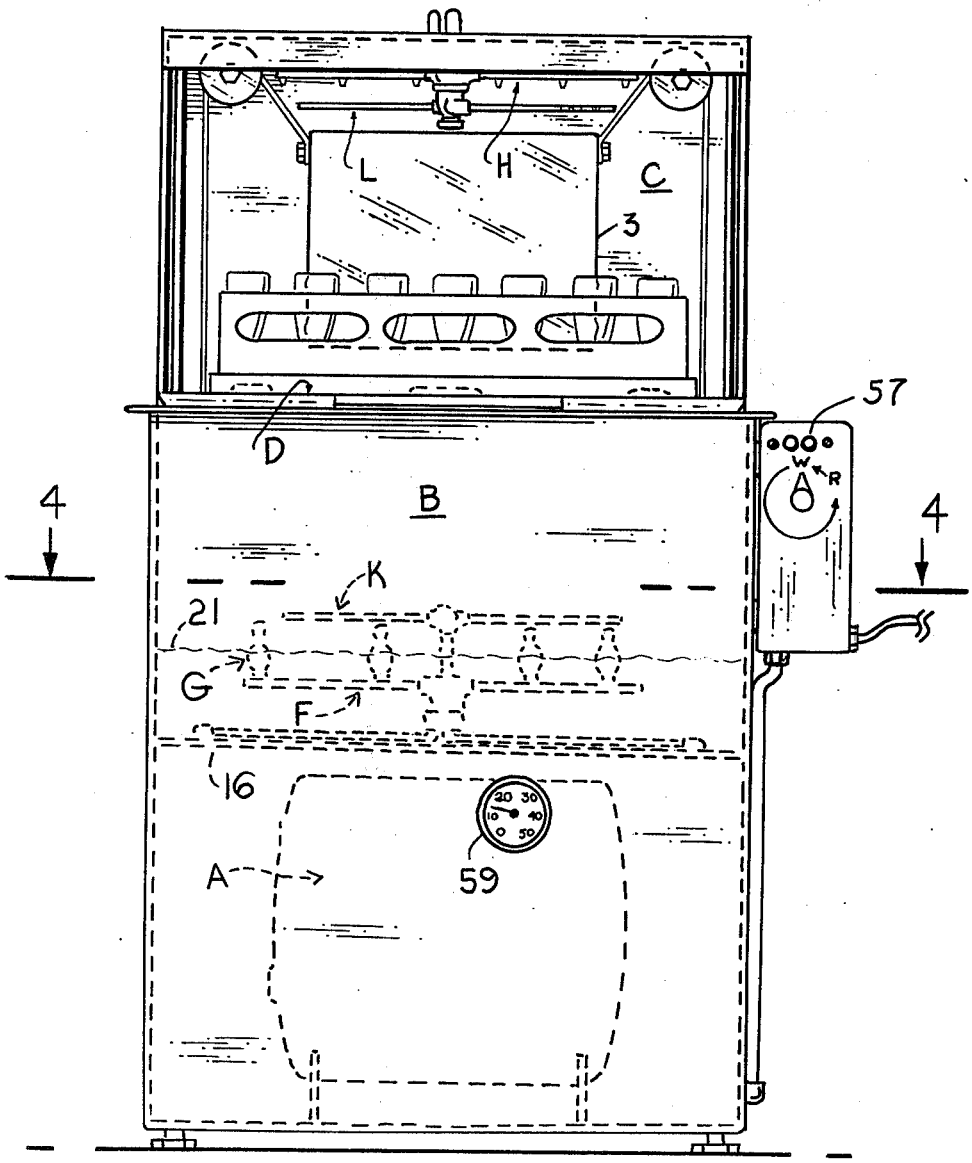
FIG. 3 is a front elevation of the dishwasher with the door to the wash/rinse compartment shown in open position.

The three-way pressure control switch is in communication with the top of the boiler A and when the steam pressure in the boiler is about 15 p.s.i., and the water temperature is about 220° F., the switch 58 will close an electric circuit to start the timer motor M. The operator has already placed the basket E with its soiled dishes in the wash/rinse compartment C, and has closed the door D. A steam pressure gage 59', shown in FIGS. 2, 3 and 8 indicates the steam pressure in the boiler A, and FIG. 8 indicates a safety valve 60 that will permit the escape of steam when the boiler steam pressure exceeds 15 p.s.i. Again we do not wish to be limited to any particular steam pressure. When the steam pressure in the boiler A reaches 15 psi, the circuit to the heating elements J will be cut off and this is controlled by the solenoid switch 59. In case of low water in the boiler, the low water cut-off switch 61 will disconnect the circuit to the heating elements, see FIG. 8. Normally, the water level control switch 11 will actuate the solenoid 10 to maintain the water level 12 in the boiler at the point shown.

A closing of the switches 57 and 58 will start the timer motor M, and the three cams N, P and Q will start rotating in unison, see FIG. 8. The cam N controls the entire wash and rinse cycles and when both are completed at the end of one revolution of the cam, a cam follower 62 will drop into the cam notch 63 and permit a trip 64 to open the ON/OFF switch which will stop the dishwasher from operating. The next cam P, will raise a micro-switch arm 64 and close the micro-switch 65 for starting the dishwashing operation. The closing of this micro-switch will open the steam solenoid 14 and permit steam to enter the pipe 13 from the boiler A and to deliver steam to the lower wash arm F, and through the branch line 26 to the upper wash arm H, in the manner already described. We have already described how the water level 21 in the tank B, can be lowered to the level 29, shown in FIG. 5, if the operator wishes a pulsating action of the steam and hot water during the dishwashing cycle.

The washing cycle cam P, is timed to cover a 60 second cycle at which time the cam will permit the micro-switch 65, see FIG. 8, to open and the dishwashing cycle to stop because the solenoid valve 14 closes. When the counterclockwise rotating wash cycle cam P reaches the 60 second elapsed time, the micro-switch arm 64 drops into the low portion 66 of the cam and the micro-switch 65 will open to stop the washing cycle. At the same instant the rinse cycle cam Q will have its high rim portion 67 raise the micro-switch arm 68 and close the micro-switch 69 to start the rinse cycle. This will close an electric circuit to open the solenoid valve 38 and hot rinse water at 180° F., will flow through the pipes 39, 41 and 48 to convey the rinse water to the lower rinse arm K, and the upper rinse arm L, in the manner already described. The rinse spray nozzles 45 in the lower rinse arm K and the rinse spray nozzles 52 in the upper rinse arm L, see FIGS. 5, 5A, 6 and 7, will cause these rinse arms to rotate.

It will be seen from this description of the washing and rinsing operations of the dishwasher that the use of a boiler for supplying both steam and water for the washing operation and hot water for the rinsing operation, we have done away with the need for the usual electric motor and pump now used on commercial dishwashers. The dish rinsing cycle is completed in about 12 seconds at which time the rinse cam Q permits the micro-switch to open and thus close the rinse water solenoid valve 38. At the same instant the timing cycle cam N, has completed one revolution and the cam follower 62 will drop into the notch 63 of the cam and permit the micro-switch arm 64 to open the ON/OFF switch 57 and stop the entire dishwasher from further operation. If another basket E of soiled dishes is to be washed and rinsed while the steam and hot water in the boiler have not had the opportunity to appreciably cool off, there will be no waiting period for the two heating elements J to raise the water temperature and steam pressure and the dishwashing operation will start at once. The tank B may be drained of its wash water when no more dishes are to be washed and this is accomplished by merely removing the overflow pipe 30 from its drain connection 31.

In FIGS. 9 and 10, we show a slightly modified form of the dishwasher. In this form the steam jets are stationary and are not mounted on a rotatable wash arm. In all other respects they are the same as the steam jet 22 enclosed in the perforated ball-shaped housing G, in FIG. 5. In both FIGS. 9 and 10, the steam pipe 13 communicates with a substantially centrally disposed housing 70 from which steam conveying pipes 71 radially extend. The housing 70 is supported by the bottom 16 for the tank B, and the radial steam pipes 71 communicate with satillite housings 72 that are also supported by the tank bottom 16. The steam jets are in communication with the housings 72 and are enclosed in perforated ball-shaped housings R, that are similar to the housings G and G', shown in FIG. 5 and 2 respectively. Water/-steam deflectors 73 are connected to the outlets of the housings R, and are similar to the deflector 25, shown in FIG. 5. The central housing 70 also has a perforated ball-shaped housing R, and a deflector 73, see FIG. 9. The steam jets with their deflectors 73 function in exactly the same way as the steam jet deflectors 25 in FIG. 5, during the washing cycle except that the deflectors 73 are stationary and the deflectors 25 travel around with the lower wash arm F, in FIG. 5. We can also mount stationary steam jets, not shown, to the underside of the hood 2 of the dishwasher. The jets 46 on the rinse arm K, are not changed in the modified form of our dishwasher from that shown in FIG. 5.

In FIG. 11, we show a second modified form for the lower wash arm F. Instead of mounting several steam and water entraining devices G, on the lower wash arm F, as shown in FIG. 5, we mount a steam and water entraining member S, on the bottom 16 of the tank B. Steam is delivered to the member S by the steam pipe 41, in FIG. 11. The steam flows through the steam jet and entrains water in the perforated housing 76 so that both steam and water will be delivered to the lower wash arm T, which has jets 76' for directing the steam and water upwardly against the basket E, containing dishes. The water level in the tank B, in FIG. 11 can be lowered by adjusting the overflow pipe 30 to effect a pulsating effect in the manner already described.

We claim:

1. In a dishwasher:

(a) a wash/rinse compartment with a door giving access to the compartment, the compartment being adapted to removably enclose a dish-carrying basket;

(b) a tank underlying said compartment and adapted to receive water therefrom, the tank holding a predetermined volume of water;

(c) a boiler containing a volume of water with heating means therein for heating the water and for generating steam in the boiler;

(d) a first hollow wash arm rotatably mounted and having steam jets communicating with the interior of said arm;

(e) a perforated housing enclosing each steam jet and having an outlet positioned adjacent to the jet, the housing being partially submerged in the water in said tank; and (f) means for conveying steam from said boiler to said wash arm for causing steam to issue from each jet, the force of the steam in passing from the jet and exhausting through said housing outlet entraining water from the interior of the housing so that both steam and hot water is sprayed onto the dishes in the basket, the tank water continuing to enter each housing and the hot water plus any condensed steam returning from the compartment to the tank.

2. The combination as set forth in claim 1: and in which (a) a second hollow wash arm is rotatably mounted above the dish-carrying basket and has jets directed toward the basket;

(b) said steam conveying means including a steam pipe portion for feeding steam into a jet that is enclosed in a perforated housing, said last-named housing being partially submerged in the tank water so that water will enter it;

(c) said last-named housing having an outlet positioned adjacent to the jet contained within it so that a flow of steam through said steam pipe, jet and adjacent outlet will entrain tank water contained within the housing and deliver both steam and hot water to the outlet; and (d) means for conveying the steam and hot water from the outlet of said last-named housing to said second arm where both the steam and hot water will issue from the jets on said second arm and will spray steam and hot water down upon the dishes in the basket.

3. The combination as set forth in claim 1: and in which (a) adjustable means for lowering the level of the tank water with respect to the perforated housing on said wash arm so that the steady flow of steam through said jets will deplete the hot water within said housings faster than the tank water can enter the housings;

(b) whereby only steam will flow through the jets during the interim lack of supply of sufficient tank water in the housings for the steam to entrain the water and then when the housings are again full of tank water, the steam will entrain the water thereby creating a surging or pulsating effect on the hot water being sprayed from the jets.

4. The combination as set forth in claim 3: and in which (a) the adjustable means for lowering the tank water level will similarly affect the tank water entering the perforated housing associated with the steam pipe portion communicating with the second wash arm;

(b) whereby a pulsating action of steam and hot water will issue from the jets in said second wash arm.

5. In a dishwasher:

(a) a wash/rinse compartment with a door giving access to the compartment, the compartment being adapted to removably enclose a dish-carrying basket;

(b) a tank underlying said compartment and adapted to receive water therefrom, the tank holding a predetermined volume of water;

(c) a boiler containing a volume of water with heating means therein for heating the water and for generating steam in the boiler;

(d) a first hollow wash arm rotatably mounted below the basket and having jets;

(e) a steam jet enclosed in a perforated housing, the housing being partially submerged in the body of water and having an outlet disposed close to the jet; and (f) steam conveying means for conveying steam from the steam in said boiler to the jet and fluid conveying means for conveying steam and water from the housing to said wash arm, the force of the steam in passing from the jet and exhausting through said housing outlet entraining water from the housing interior so that both steam and hot water is sprayed by the wash arm jets onto the dishes in the basket.

6. The combination as set forth in claim 5: and in which (a) adjustable means is used for lowering the level of the body of water with respect to said perforated housing so that the steady flow of steam through said jet will deplete the water within said housing faster than the body of water can enter the housing; and (b) whereby only steam will flow through the jet during the interim where there is insufficient water within said housing for the steam from the jet to entrain any water therewith, and then when the housing does receive sufficient water therein the steam will again entrain the water, thereby creating a surging or pulsating effect on the hot water being sprayed from the wash arm jets onto the dishes.

7. In a dishwasher:

(a) a wash/rinse compartment for receiving and supporting a dish-carrying basket;

(b) a tank underlying said compartment and adapted to receive water therefrom, the tank holding a predetermined volume of water;

(c) a boiler containing a volume of water with heating means therein for heating the water and generating steam within said boiler;

(d) a first hollow wash arm for spraying water onto the dishes in said compartment;

(e) a first means associated with said arm and boiler for conveying steam from said boiler and mixing it with a supply of water from the tank water for causing said hollow wash arm to direct steam and water against the dishes during the washing cycle;

(f) a first hollow rinse arm mounted for spraying rinse water onto the dishes;

(g) a second means associated with said rinse arm and said boiler for conveying hot water from said boiler to said rinse arm for rinsing the dishes during the rinse cycle;

(h) means for feeding fresh water into said boiler;

(i) means for feeding fresh water into said rinse arm;

(j) a temperature controlled mixing valve for controlling the flow of fresh water from the fresh water supply to the rinse arm and mixing it with the hot water from the boiler for maintaining the same temperature for the rinse water; and (k) timing means for first activating said first means for washing the dishes for a predetermined time period and subsequently activating said second means for rinsing the dishes for a predetermined time period.

* * * * *